US011511209B2

(12) United States Patent
Liu

(10) Patent No.: US 11,511,209 B2
(45) Date of Patent: Nov. 29, 2022

(54) PADDLING METHOD FOR CRAFT

(71) Applicant: HUIZHOU VICTORY TECHNOLOGY LTD., Guangdong (CN)

(72) Inventor: Hesheng Liu, Hunan Province (CN)

( * ) Notice: Subject to any disclaimer, the term of this patent is extended or adjusted under 35 U.S.C. 154(b) by 796 days.

(21) Appl. No.: 16/429,661

(22) Filed: Jun. 3, 2019

(65) Prior Publication Data

US 2020/0011331 A1 Jan. 9, 2020

(30) Foreign Application Priority Data

Jul. 3, 2018 (CN) ..... 201810714962.1

(51) Int. Cl.
*A63H 23/04* (2006.01)
*A63H 29/14* (2006.01)

(52) U.S. Cl.
CPC ..... *A63H 23/04* (2013.01); *A63H 29/14* (2013.01)

(58) Field of Classification Search
CPC ..... A63H 3/50; A63H 23/04; A63H 23/12; A63H 23/14; A63H 29/14; A63H 23/10
USPC ..... 446/153, 156, 160, 163, 164, 165, 159
See application file for complete search history.

(56) References Cited

U.S. PATENT DOCUMENTS 4,045,907 A * 9/1977 Mumford ..... A63H 23/06 446/160
4,277,908 A * 7/1981 Nikaido ..... A63H 23/10 446/158
4,313,277 A * 2/1982 Klawitter ..... A63H 23/06 446/163
4,622,019 A * 11/1986 Katzman ..... A63H 23/10 446/268
4,687,456 A * 8/1987 Wang ..... A63H 31/00 446/158
6,062,938 A * 5/2000 Meng-Suen ..... A63H 13/04 446/132
6,422,910 B1 * 7/2002 Takaya ..... A63H 23/08 446/139
6,729,931 B2 * 5/2004 Lee ..... A63H 23/04 446/163
6,860,785 B2 * 3/2005 Vap ..... A63H 29/22 446/330
10,021,863 B2 * 7/2018 Friedman ..... A01K 97/00
10,039,989 B2 * 8/2018 McGregor ..... G09B 23/12
11,298,625 B2 * 4/2022 Vreugdenhil ..... A63H 3/50
2003/0232566 A1 * 12/2003 Vap ..... A63H 29/02 446/156

(Continued)

FOREIGN PATENT DOCUMENTS

CN 105435459 A * 3/2016
JP 2009118895 A * 6/2009

*Primary Examiner* — Alexander R Niconovich
(74) *Attorney, Agent, or Firm* — Rumit Ranjit Kanakia

(57) ABSTRACT

A paddling method for a craft is provided, which is a method for driving a rotating ring to float and rotate by the dynamic force of water. The rotating ring comprises a rotating inner ring and a rotating outer ring, at least three connectors are connected between the rotating inner ring and the rotating outer ring, an external part of the connector is provided with a rotating blade, and the rotating blade is placed in water in a water-sealing container. The paddling method for the craft of the present invention has advantages of being novel in conception and design, good in rotating scenery effects, good in impression and the like.

4 Claims, 3 Drawing Sheets

(56) References Cited

U.S. PATENT DOCUMENTS

| | | | | |
|---|---|---|---|---|
| 2011/0076910 | A1* | 3/2011 | Johnston | A63H 23/04 446/163 |
| 2013/0309939 | A1* | 11/2013 | Cheng | A63H 30/04 446/484 |
| 2015/0298015 | A1* | 10/2015 | Bausch | B63H 1/14 29/428 |
| 2020/0011331 | A1* | 1/2020 | Liu | F04D 3/00 |

* cited by examiner

PADDLING METHOD FOR CRAFT

TECHNICAL FIELD

The present invention relates to the technical field of craft paddling, and in particular, to a paddling method for a craft.

BACKGROUND

There are two methods of rotating the interior of an existing Christmas craft. One is that a placing member of the interior is driven directly by a motor to rotate, and the other is that a placing member of the interior is driven magnetically to rotate. In both methods, the placing member is directly driven by an external force, and such methods of directly driving the placing member to rotate for paddling have a single impression and poor application scenario. Moreover, the directly driving the placing member to rotate by the motor further has the following problem: a transmission shaft of the motor needs to penetrate a container, the water tightness of the transmission shaft portion penetrating the container is poor, and liquid leakage is liable to damage electronic devices in the craft such as the motor and a lamp.

SUMMARY OF THE INVENTION

A paddling method for a craft is provided in the present invention, which is novel in conception and design, good in rotating scenery effects, and good in impression.

The present invention can be implemented by the following technical solutions:

A paddling method for a craft is a method for driving a rotating ring to float and rotate by the dynamic force of water. The paddling method drives the rotating ring to rotate by the dynamic force of the water, and when the rotating ring rotates, an impression of floating on the water is provided. When an interior object such as a doll is placed on the rotating ring, the interior object rotates with the rotating ring. A desirable scenery effect is achieved during the rotation, and a good impression is provided. The method is novel in conception and design.

Further, the dynamic force of the water is realized by an impeller disposed in a water-sealing container, the impeller is a magnetic impeller driven by a driving member located outside the water-sealing container, and the driving member is a magnetic motor magnetically matching the magnetic impeller.

Further, the rotating ring includes a rotating inner ring and a rotating outer ring, at least three connectors are connected between the rotating inner ring and the rotating outer ring, an external part of the connector is provided with a rotating blade, and the rotating blade is disposed in water in the water-sealing container. When the water flows under the action of an external force, the flowing water provides a driving force for the rotating blade disposed in the water, thereby driving the rotating ring with the rotating blade to rotate in the flow direction of the water. The rotating blade on the rotating ring is disposed in the water, so the rotating ring floats and rotates in the flow and fluctuation directions of the water during rotation, thus enhancing a user's impression and experience.

Further, the width direction of the rotating blade is distributed perpendicular to the dynamic force direction of the water, so as to increase the dynamic contact surface of the rotating blade and the water, thereby effectively ensuring that the rotating ring can rotate rapidly under the constant dynamic force of the water. Meanwhile, the dynamic force of the water can be saved effectively, thus effectively reducing energy consumption.

Further, a bearing is disposed inside the rotating inner ring, and the rotating inner ring of the rotating ring is fixedly connected to an outer ring of the bearing and rotates along an inner ring of the bearing under the dynamic force of the water. An upper part of the inner ring of the bearing is provided with an interior table for placing an object, and the interior table is disposed through the inner ring of the bearing and fitted to a supporting member mounted on the water-sealing container. The interior table is such configured that it is disposed through the inner ring of the bearing and fitted to the supporting member. During the rotation of the rotating ring with the outer ring of the bearing along the inner ring of the bearing, the connection between the interior table and the supporting member is fixed. By setting different interiors on the interior table and the rotating ring respectively, a magical or dreamlike experience is provided, which is much better than the experience of the conventional method of directly driving the rotating ring to rotate by an external force.

Further, the supporting member includes a supporting plate, and the bottom of the supporting plate is provided with a plurality of support mounting posts for mounting on the water-sealing container. The center of the supporting plate is provided with a cylindrical support protrusion protruding upward, and the bottom of the interior table is provided with a cylindrical table protrusion protruding downward and matching the support protrusion. The inner circumferential surface of the support protrusion is provided with at least one support flat surface, and the outer circumferential surface of the table protrusion is provided with a table flat surface matching the support flat surface. The outer circumference of the bottom of the support protrusion in contact with an upper surface of the supporting plate is provided with a plurality of outwardly extending support extension ribs; the outer circumference of the top of the table protrusion in contact with the bottom of the table is provided with a plurality of outwardly extending table extension ribs, and the support extension ribs and the table extension ribs are respectively used for fixing the bottom and the top of the inner ring of the bearing.

Further, the paddling method for a craft of the present invention is implemented based on a paddling device including a water-sealing container or a water-sealing ring, wherein the water-sealing container is provided with an impeller, and the center of an intermediate fixing block of the impeller is respectively provided with a lower mounting hole for a pointed protrusion that is raised upward in the middle and mounted in the water-sealing container, and an upper mounting hole for mounting a downward protrusion at the bottom of the supporting member, and the impeller is fixed between the supporting member and the water-sealing container. A rotating ring assembly is disposed above the supporting member, and the rotating ring assembly includes a rotating ring, an interior table, and a bearing. The rotating ring is firstly sleeved on the outside of the bearing and is rotatably connected to the bearing, and then the bearing is sleeved on the supporting member together with the rotating ring. Then, the interior table is mounted to the supporting member to fix the inner ring of the bearing between the interior table and the supporting member, the outer ring of the bearing rotates along the inner ring of the bearing, and the rotating ring floats and rotates with the outer ring of the bearing under the dynamic force of water along the inner ring of the bearing.

The paddling method for a craft of the present invention has the following beneficial effects.

Firstly, the paddling method for a craft of the present invention drives the rotating ring to rotate by the dynamic force of the water, and when the rotating ring rotates, an impression of floating on the water is provided. When an interior object such as a doll is placed on the rotating ring, the interior object rotates with the rotating ring. A desirable scenery effect is achieved during the rotation, and a good impression is provided. The method is novel in conception and design.

Secondly, the interior table is such configured that it is disposed through the inner ring of the bearing and fitted to the supporting member. During the rotation of the rotating ring with the outer ring of the bearing along the inner ring of the bearing, the connection between the interior table and the supporting member is fixed. By setting different interiors on the interior table and the rotating ring respectively, a magical or dreamlike experience is provided, which is much better than the experience of the conventional method of directly driving the rotating ring to rotate by an external force.

DETAILED DESCRIPTION

Figure 1:
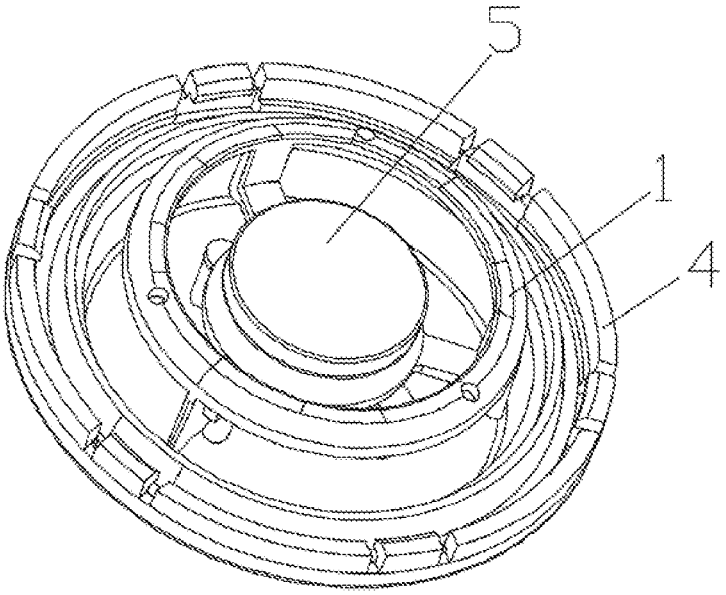
FIG. 1 is a schematic structural diagram of a device using a paddling method for a craft according to the present invention.

In order to enable those skilled in the art to better understand the technical solutions of the present invention, the product of the present invention will be further described in detail below with reference to the embodiments and the accompanying drawings.

As shown in FIG. 1 to FIG. 6, a paddling method for a craft is a method for driving a rotating ring 1 to float and rotate by the dynamic force of water. In the paddling method, the rotating ring 1 is driven to rotate by the dynamic force of the water, and when the rotating ring 1 rotates, an impression of floating on the water is provided. When an interior object such as a doll is placed on the rotating ring 1, the interior object rotates with the rotating ring 1. A desirable scenery effect is achieved during the rotation, and a good impression is provided. The method is novel in conception and design. Specifically, the dynamic force of the water is realized by an impeller 3 disposed in a water-sealing container 4, the impeller 3 is a magnetic impeller 3 driven by a driving member located outside the water-sealing container 4, and the driving member is a magnetic motor magnetically matching the magnetic impeller 3. The rotating ring 1 includes a rotating inner ring 12 and a rotating outer ring 11, at least three connectors 13 are connected between the rotating inner ring 12 and the rotating outer ring 11, an external part of the connector 13 is provided with a rotating blade 14, and the rotating blade 14 is disposed in water in the water-sealing container. When the water flows under the action of an external force, the flowing water provides a driving force for the rotating blade 14 disposed in the water, thereby driving the rotating ring 1 with the rotating blade 14 to rotate in the flow direction of the water. The rotating blade 14 on the rotating ring 1 is disposed in the water, so the rotating ring 1 floats and rotates in the flow and fluctuation directions of the water during rotation, thus enhancing a user's impression and experience. The width direction of the rotating blade 14 is distributed perpendicular to the dynamic force direction of the water, so as to increase the dynamic contact surface of the rotating blade 14 and the water, thereby effectively ensuring that the rotating ring 1 can rotate rapidly under the constant dynamic force of the water. Meanwhile, the dynamic force of the water can be saved effectively, thus effectively reducing energy consumption.

Figure 2:
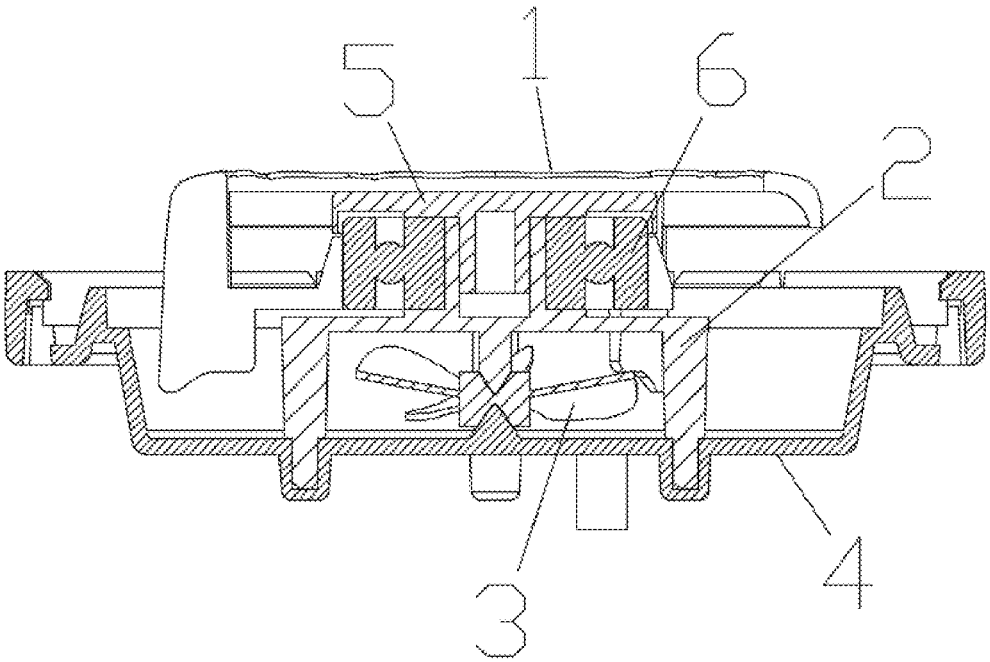
FIG. 2 is a schematic cross-sectional diagram of FIG. 1.
Figure 4:
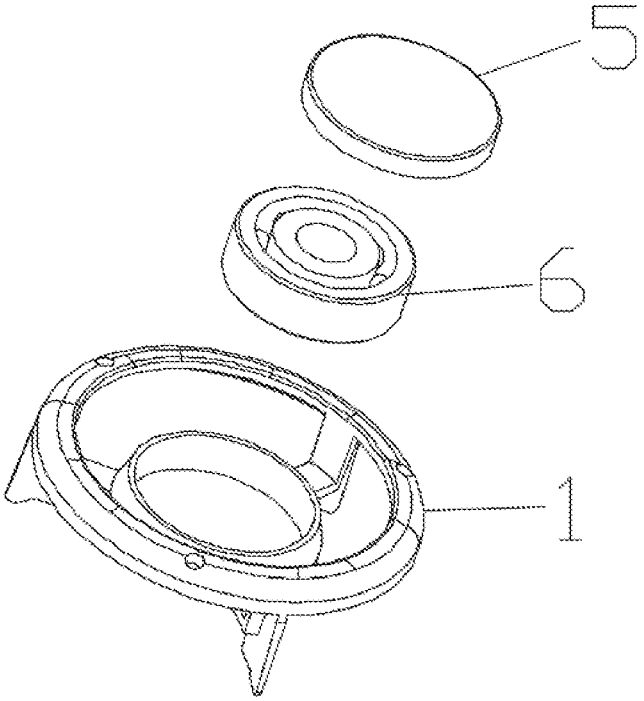
FIG. 4 is a schematic exploded diagram of the rotating ring assembly of FIG. 3.
Figure 5:
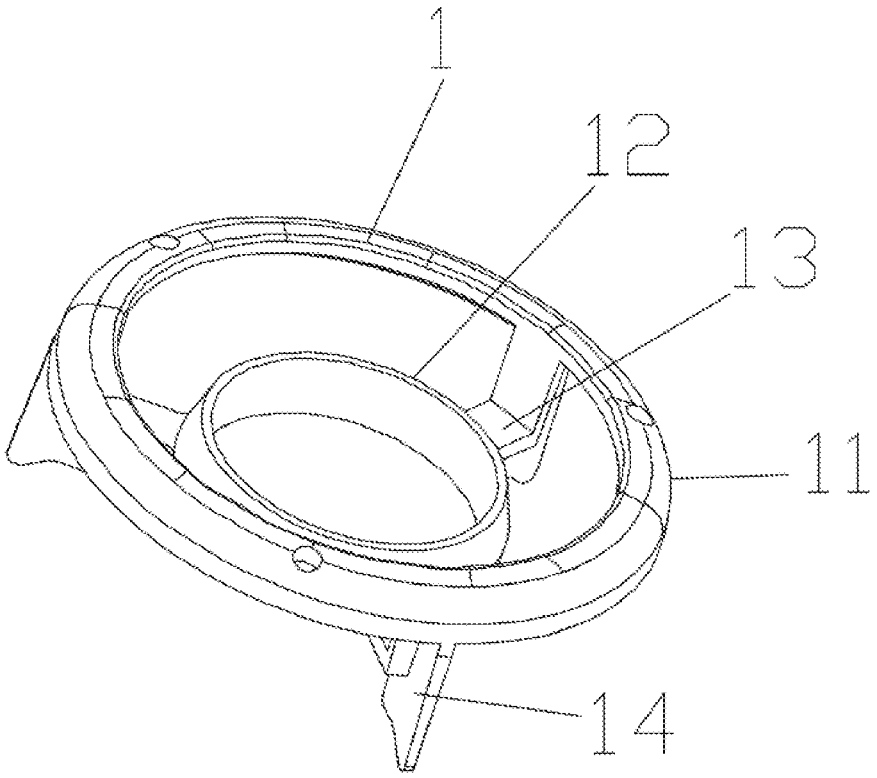
FIG. 5 is a schematic structural diagram of the rotating ring of FIG. 3.

As shown in FIG. 2 and FIG. 4, a bearing 6 is disposed inside the rotating inner ring 12, and the rotating inner ring 12 of the rotating ring 1 is fixedly connected to an outer ring of the bearing 6 and rotates along an inner ring of the bearing 6 under the dynamic force of the water. An upper part of the inner ring of the bearing 6 is provided with an interior table 5 for placing an object, and the interior table 5 is disposed through the inner ring of the bearing 6 and fitted to a supporting member 2 mounted on the water-sealing container 4. The setting of the interior table 5 is such that the interior table 5 is disposed through the inner ring of the bearing 6 and fitted to the supporting member 2. During the rotation of the rotating ring 1 with the outer ring of the bearing 6 along the inner ring of the bearing 6, the connection between the interior table 5 and the supporting member 2 is fixed. By setting different interiors on the interior table 5 and the rotating ring 1 respectively, a magical or dreamlike experience is provided, which is much better than the experience of the conventional method of directly driving the rotating ring to rotate by an external force.

Figure 3:
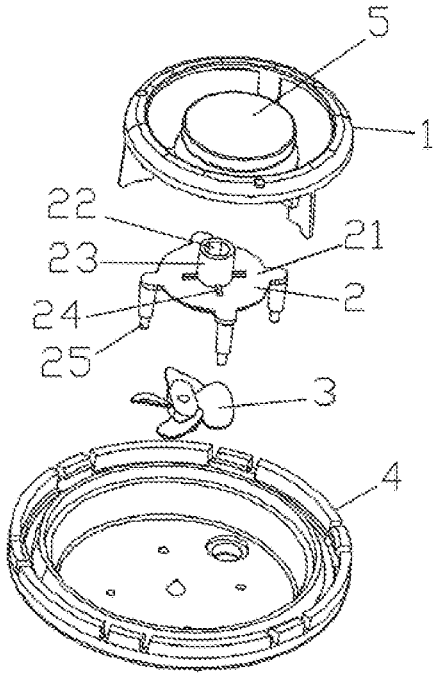
FIG. 3 is a schematic exploded diagram of FIG. 1.
Figure 6:
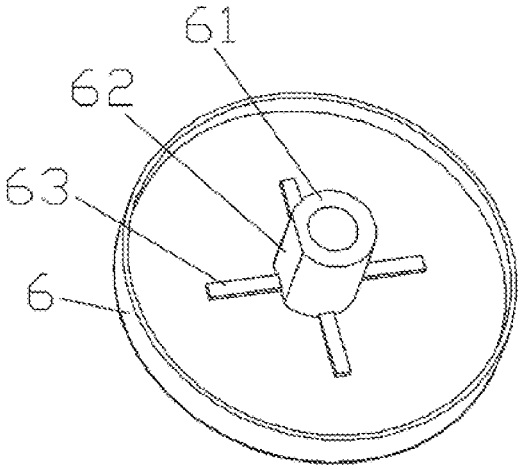
FIG. 6 is a schematic structural diagram of the interior table of FIG. 4.

As shown in FIG. 3 and FIG. 6, the supporting member 2 includes a supporting plate 21, and the bottom of the supporting plate 21 is provided with a plurality of support mounting posts 25 for mounting on the water-sealing container 4. The center of the supporting plate 21 is provided with a cylindrical support protrusion 23 protruding upward, and the bottom of the interior table 5 is provided with a cylindrical table protrusion 61 protruding downward and matching the support protrusion 23. The inner circumferential surface of the support protrusion 23 is provided with at least one support flat surface 22, and the outer circumferential surface of the table protrusion 61 is provided with a table flat surface 62 matching the support flat surface 22. The outer circumference of the bottom of the support protrusion 23 in contact with an upper surface of the supporting plate 21 is provided with a plurality of outwardly extending support extension ribs 24; the outer circumference of the top of the table protrusion 61 in contact with the bottom of the table is provided with a plurality of outwardly extending table extension ribs 63, and the support extension ribs 24 and the table extension ribs 63 are respectively used for fixing the bottom and the top of the inner ring of the bearing 6.

As shown in FIG. 1 to FIG. 6, the paddling method for a craft of the present invention is implemented based on a paddling device including a water-sealing container 4 or a water-sealing ring, wherein the water-sealing container 4 is provided with an impeller 3, and the center of an intermediate fixing block of the impeller 3 is respectively provided with a lower mounting hole for a pointed protrusion that is raised upward in the middle and mounted in the water-sealing container 4, and an upper mounting hole for mounting a downward protrusion at the bottom of the supporting member 2, and the impeller 3 is fixed between the supporting member 2 and the water-sealing container 4. A rotating ring 1 assembly is disposed above the supporting member 2, and the rotating ring 1 assembly includes a rotating ring 1, an interior table 5, and a bearing 6. The rotating ring 1 is firstly sleeved on the outside of the bearing 6 and is rotatably connected to the bearing 6, and then the bearing 6 is sleeved on the supporting member 2 together with the rotating ring 1. Then, the interior table 5 is mounted to the supporting member 2 to fix the inner ring of the bearing 6 between the interior table 5 and the supporting member 2, the outer ring of the bearing 6 rotates along the inner ring of the bearing 6, and the rotating ring 1 floats and rotates with the outer ring of the bearing 6 under the dynamic force of water along the inner ring of the bearing 6.

The above is only the preferred embodiment of the present invention, and is not intended to limit the present invention in any way. Those of ordinary skill in the art can smoothly implement the present invention according to the content shown in the accompanying drawings and the above description. However, those skilled in the art can make some equivalent changes including variations, modifications and evolutions using the technical contents disclosed above without departing from the scope of the technical solutions of the present invention. At the same time, variations, modifications and evolutions of any equivalent changes made to the above embodiments according to the essential techniques of the present invention shall still fall within the protection scope of the technical solutions of the present invention.

The invention claimed is:

1. A paddling method for a craft, comprising rotating a rotating ring by dynamic force of water;

wherein the water is powered by an impeller disposed in a water-sealing container, and the impeller is a magnetic impeller driven by a driving member located outside the water-sealing container;

the rotating ring comprises a rotating inner ring and a rotating outer ring, at least three connectors are connected between the rotating inner ring and the rotating outer ring, an external part of the connector is provided with a rotating blade, and the rotating blade is placed in water in the water-sealing container;

a width direction of the rotating blade is distributed perpendicular to a dynamic force direction of the water;

the rotating inner ring is provided with a bearing, and the rotating inner ring of the rotating ring is fixedly connected to an outer ring of the bearing and rotates along an inner ring of the bearing under the dynamic force of the water;

an upper part of the inner ring of the bearing is provided with an interior table for placing an object, and the interior table is disposed through the inner ring of the bearing and fitted to a supporting member mounted in the water-sealing container;

the supporting member comprises a supporting plate, and a bottom of the supporting plate is provided with a plurality of support mounting posts for mounting on the water-sealing container.

2. The paddling method for a craft according to claim 1, wherein a center of the supporting plate is provided with a cylindrical support protrusion protruding upward, and a bottom of the interior table is provided with a cylindrical table protrusion protruding downward and matching the cylindrical support protrusion.

3. The paddling method for a craft according to claim 2, wherein an inner circumferential surface of the cylindrical support protrusion is provided with at least one support flat surface, and an outer circumferential surface of the cylindrical table protrusion is provided with a table flat surface matching the support flat surface.

4. The paddling method for a craft according to claim 3, wherein an outer circumference of a bottom of the cylindrical support protrusion in contact with an upper surface of the supporting plate is provided with a plurality of outwardly extending support extension ribs;

an outer circumference of a top of the cylindrical table protrusion in contact with a bottom of the table is provided with a plurality of outwardly extending table extension ribs, and the plurality of outwardly extending support extension ribs and the plurality of outwardly extending table extension ribs are respectively used for fixing a bottom and a top of the inner ring of the bearing.

* * * * *